US006461114B1

(12) United States Patent
Lin

(10) Patent No.: US 6,461,114 B1
(45) Date of Patent: Oct. 8, 2002

(54) SWITCH FOR PEDESTAL SUMP PUMP

(75) Inventor: Chih M. Lin, Tipp City, OH (US)

(73) Assignee: A. O. Smith Corporation, Milwaukee, WI (US)

( * ) Notice: Subject to any disclaimer, the term of this patent is extended or adjusted under 35 U.S.C. 154(b) by 155 days.

(21) Appl. No.: 09/633,993

(22) Filed: Aug. 8, 2000

(51) Int. Cl.[7] ..... F04B 49/04
(52) U.S. Cl. ..... 417/40; 200/61.2
(58) Field of Search ..... 417/40; 200/61.2, 200/84 R, 84 A, 84 B, 573

(56) References Cited

U.S. PATENT DOCUMENTS 2,792,467 A 5/1957 Hollinshead
3,153,709 A 10/1964 Kraemer
3,979,569 A 9/1976 Bilgrei
4,001,533 A 1/1977 Conery et al.
4,295,017 A * 10/1981 Kashima et al. ..... 200/47
4,394,553 A 7/1983 Feil
4,404,441 A 9/1983 MacLaren
5,076,762 A * 12/1991 Lykes et al. ..... 417/40

* cited by examiner

*Primary Examiner*—Charles G. Freay
*Assistant Examiner*—William H Rodriguez
(74) *Attorney, Agent, or Firm*—Michael Best & Friedrich LLP

(57) ABSTRACT

A pedestal sump pump includes a motor with a housing and a water-level-response system attached to the motor. The water-level-response system includes a connecting rod with upper and lower limit stops, a float, and a switch assembly mounted partially within the motor housing. The assembly includes a switch housing and a lever pivotably mounted to the switch housing such that the lever can be toggled between on and off positions. The lever includes an aperture in the first end of the lever and a cam surface on the second end of the lever. The assembly also includes a retainer clip removably attached to the housing to retaining the lever in place, the clip including a spring tab to force the lever into one of the on and off positions, and a microswitch removably mounted in the switch housing.

20 Claims, 4 Drawing Sheets

SWITCH FOR PEDESTAL SUMP PUMP

FIELD OF THE INVENTION

The invention relates to pedestal sump pumps and to switches for controlling the operation of such pumps.

BACKGROUND OF THE INVENTION

Pedestal sump pumps require a switch that can cause the pump to be switched on and off based on the functioning of a float mechanism reacting to the water level in a sump. Because of the special functionality necessary in these switches, the switches in prior art pumps are typically complicated. In most cases, these switches need to mounted adjacent or on top of the motor housing due to their size. Prior art sump pump switches are also typically bulky and expensive to build and maintain. Mounting such a switch outside of the motor housing exposes the switch to potential damage.

SUMMARY OF THE INVENTION

The invention provides an improved switch assembly that solves these problems through a simple design and a small size that allow the switch assembly to be mounted within a motor housing. The switch assembly is snapped together without fasteners, and is mounted within the motor housing with only one fastener. The switch assembly can employ a variety of widely-available and inexpensive microswitches. Except for the microswitch, the assembly is preferably made of three injection-molded parts and is therefore inexpensive to manufacture. The actuating lever of the switch assembly is constructed to be able to tolerate the abuse of shipping and handling.

More specifically, the invention provides a sump pump including a motor and a water-level-response system attached to the motor. The water-level-response system includes a float rod or connecting rod having thereon a float. The switch assembly is mounted inside the motor housing and includes a switch housing, a lever and a retainer, all of which are preferably injection-molded out of plastic. The switch housing is mounted inside the motor housing with a single fastener, preferably a screw. The assembly also includes a microswitch. The microswitch snaps into the switch housing from below, the lever is pivotably mounted on top of the switch housing, and the retainer snaps onto the switch housing over the lever to hold the lever on the housing. The lever engages the microswitch and can be toggled between on and off positions corresponding to the on and off or closed and open states of the microswitch. The lever extends from the motor housing and is operably connected to the float rod so that movement of the float rod opens and closes the microswitch. The retainer has a spring tab engaging a cam surface on the end of the lever so as to cause the lever to snap into the on and off positions.

Other features and advantages of the invention will become apparent to those skilled in the art upon review of the following detailed description, claims, and drawings.

Figure 1:
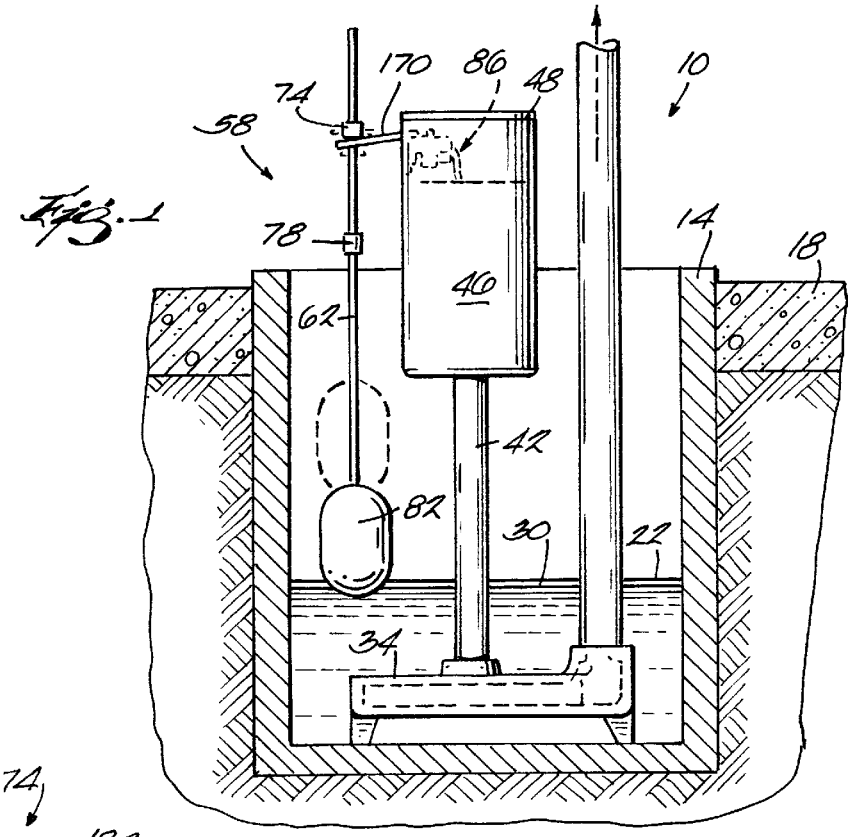
FIG. 1 is an elevation view, partially in section, of a pedestal sump pump embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENTS

A pedestal sump pump 10 embodying the invention is illustrated in FIG. 1 for exemplary purposes. While an important aspect of the invention is the provision of an improved pedestal sump pump, the invention is intended to encompass the use of the switch assembly described herein in other applications.

As illustrated in FIG. 1, the sump pump 10 is used within a sump 14 located in a floor 18. The sump 14 collects water 22 from a foundation 26. The water 22 within the sump 14 has a variable level 30. The pump 10 includes a base 34, and a support post 42 extends upwardly from the base 34. An electric motor 46 is mounted on top of the post 42. The motor 46 includes a main housing 48. The sump pump 10 as thus far described is conventional and need not be described in greater detail.

The pump 10 also includes a water-level-response system 58. The system 58 includes a float rod or connecting rod 62. The connecting rod 62 is generally vertically oriented and has thereon spaced upper and lower limit stops 74, 78. The system 58 also includes a float 82 mounted on the lower end of the rod 62. The float 82 is buoyed by the water 22 and moves upward and downward with fluctuations in the water level 30. Likewise, the connecting rod 62 moves upward and downward with the float 82. Such a float and connecting rod arrangement is known in the art.

Figure 2:
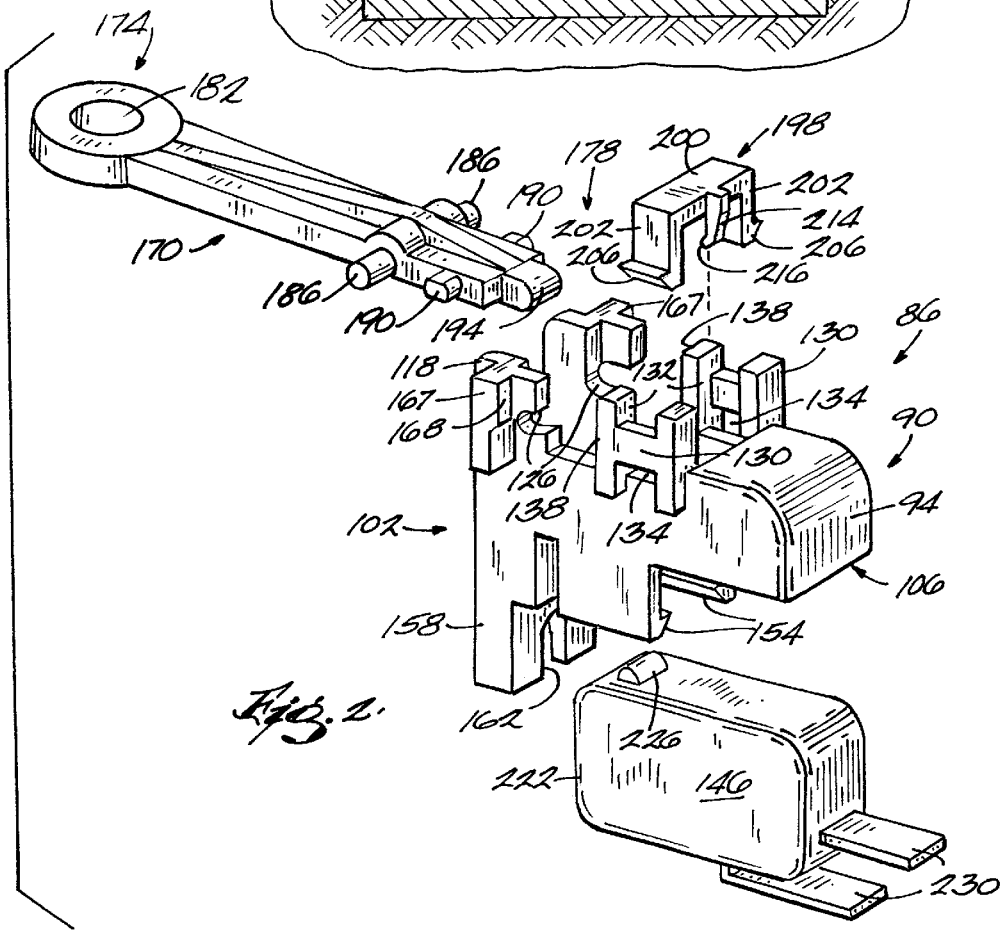
FIG. 2 is an exploded perspective view of the switch assembly of the sump pump.
Figure 3:
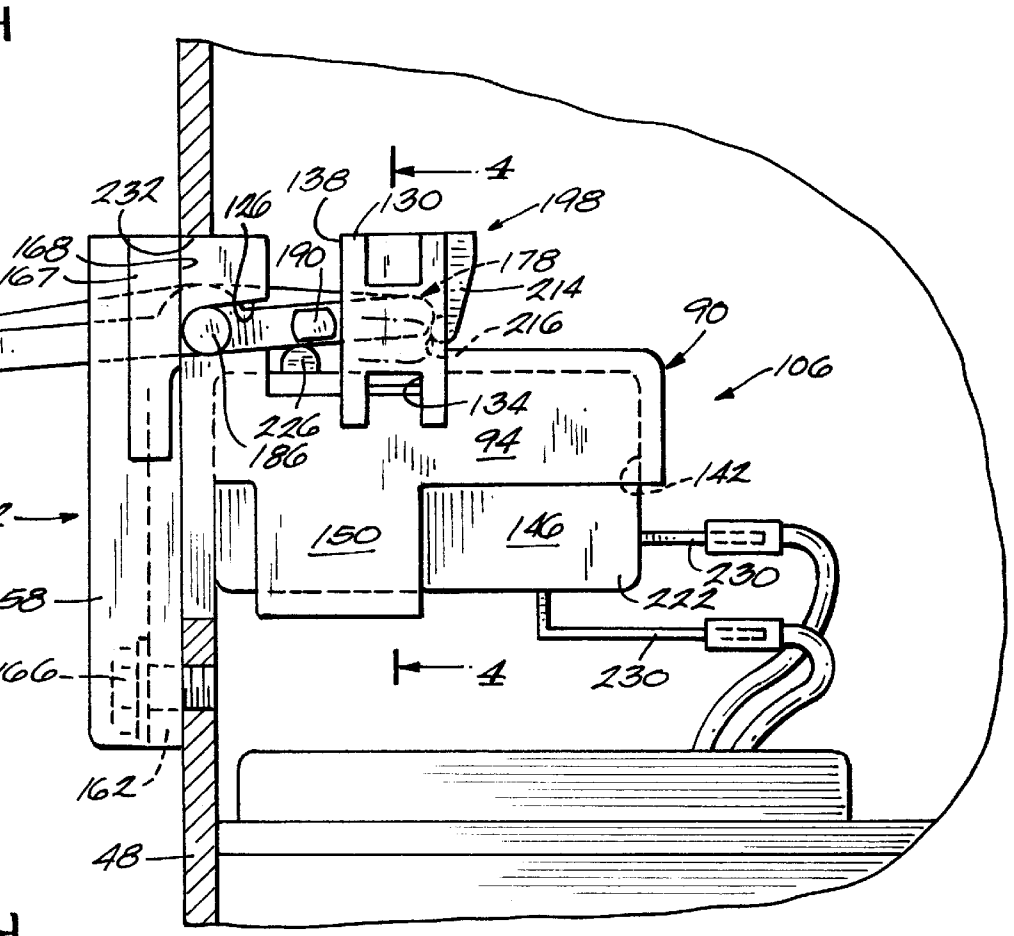
FIG. 3 is an enlarged portion of FIG. 1 partially cut away.

As best illustrated in FIGS. 2 and 3, the water-level-response system 58 also includes a switch assembly 86 mounted within the motor housing 48. The assembly 86 includes a switch housing 90 having a main body portion 94 and left and right (as seen in FIG. 3) or front and rear ends 102, 106. The switch housing 90 is generally symmetrical about a vertical center plane identified by reference numeral 110 in FIG. 4. As best shown in FIG. 2, a pair of arms 118 extend upwardly from the main body portion 94 on opposite sides of the plane adjacent the left end 102. Each arm 118 has therein a generally C-shaped recess 126 that opens rearwardly (toward the right end 106) and slightly upwardly.

The switch housing 90 also includes a pair of arms 130 that extend upwardly from the main body portion 94 on opposite sides of the plane intermediate the right and left end 102, 106. Each arm 130 is generally H-shaped and includes a vertically-oriented, inwardly-opening recess 132 such that the recesses 132 face each other. Each arm also has therein a horizontally-oriented, generally rectangular slot or recess 134. Each arm 130 also has a forward surface 138 facing the right end 102.

Figure 4:
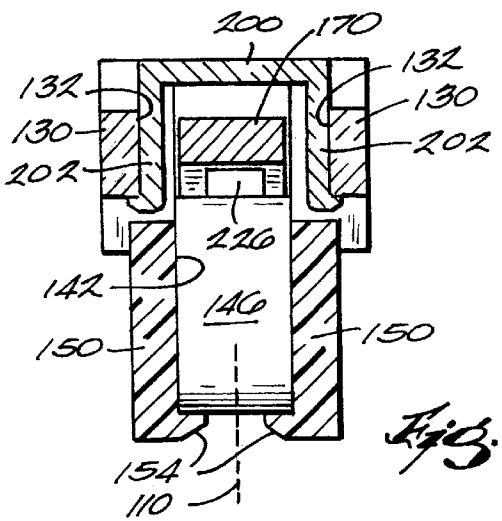
FIG. 4 is a cross-section view taken along line 4—4 in FIG. 3.
Figure 5:
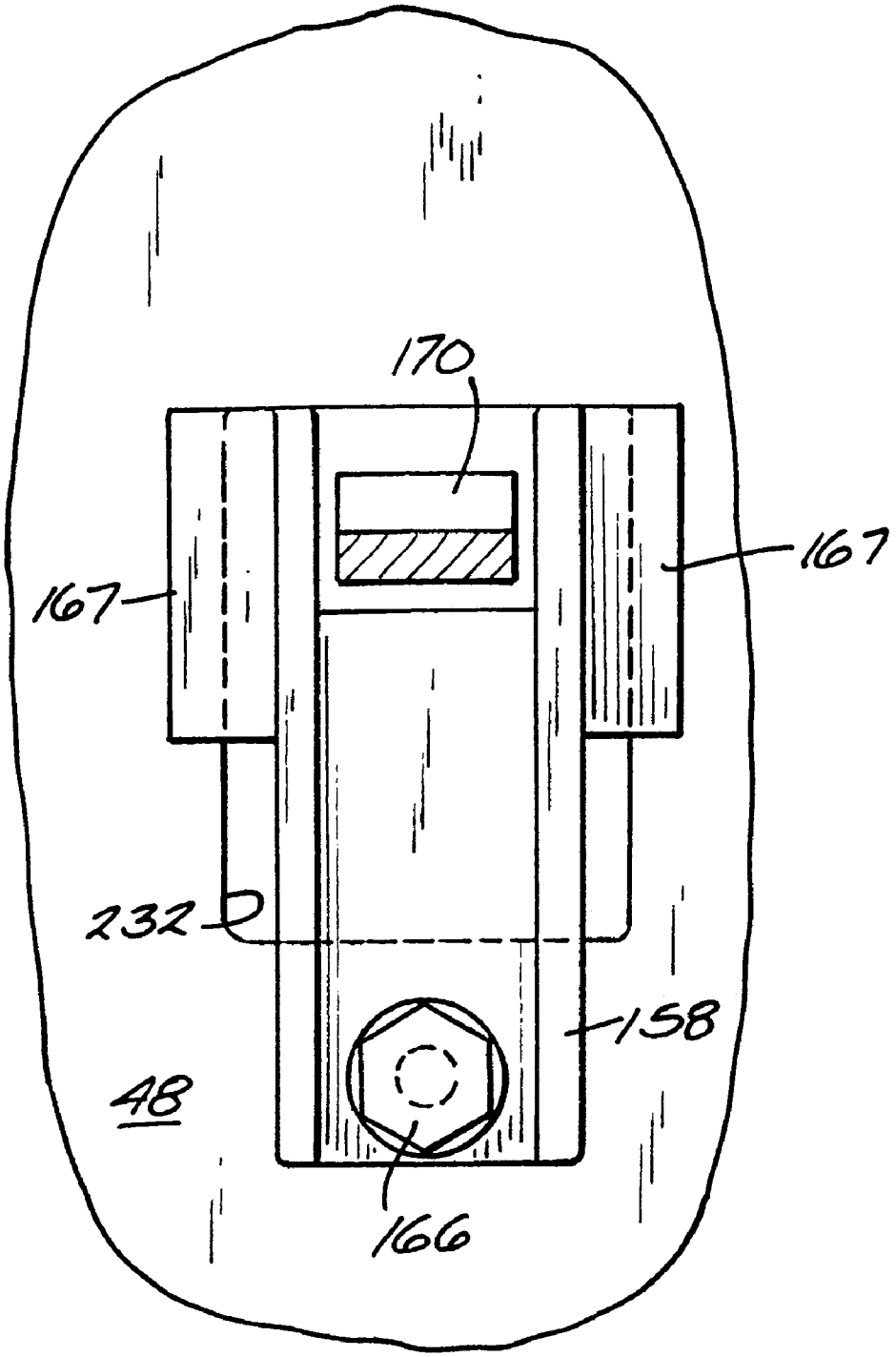
FIG. 5 is a view taken along line 5—5 in FIG. 3.

The main body portion 94 has therein a downwardly-opening microswitch recess 142. A microswitch 146, which is further described below, is housed in the recess 142. Extending downward from the main body portion 94 on opposite sides of the recess 142 are a pair of flexible arms 150. On the lower end of each arm 150 is an inwardly-projecting, beveled lip 154. When the microswitch 146 is inserted into the recess 142, engagement of the beveled lips 154 by the microswitch 146 biases the arms 150 outward until the microswitch 146 is fully inserted, at which point the arms 150 snap back into their original positions and the lips 154 extend below the microswitch 146, as best shown in FIG. 4, to retain the microswitch 146 in the recess 142.

The switch housing 90 also includes a mounting portion 158 extending from the front end of the main body portion 94. The mounting portion 158 has therein a downwardly-opening, generally U-shaped recess 162 sized to accommodate a mounting screw 166 such that the switch housing 90 can be mounted within the motor housing 48 with a single screw 166 extending through the recess 162. In alternative embodiments, the mounting portion 158 may be located elsewhere on the switch housing 90. In other alternative embodiments, the recess can be replaced with an aperture, other types of fasteners can be used, or any other suitable attachment method can be employed, such as having a projection on the switch housing 90 snap into an opening in the motor housing 48. The housing 90 could also be attached to a part of the motor 46 other than the housing 48. The mounting portion 158 also includes a pair of wings or projections 167 each having a rearwardly facing surface 168 (only one is shown in FIG. 2) that abuts the outside of the motor housing 48 when the switch assembly 86 is installed in the housing as described below.

The switch assembly 86 also includes a lever 170 with right and left or front and rear ends 174, 178. The lever 170 is pivotably mounted on the switch housing 90 in a manner described below such that the lever 170 can be toggled between an on position (partially shown in phantom in FIG. 3) and an off position (shown in solid lines in FIG. 3). The front end 174 of the lever 170 is enlarged and has therein an aperture 182 that slidably receives the connecting rod 62, but that is smaller than the limit stops 74, 78 so that the limit stops 74, 78 cannot pass through the aperture 182, and thus can pivot the lever 170. The lever 170 has thereon a pair of oppositely-extending, generally cylindrical pivots 186 each pivotably mounted within a respective recess 126 of a respective arm 118. The lever 170 pivots relative to the housing about the pivots 186.

The lever 170 also includes a pair of oppositely-extending retaining 10 projections or "pivots" 190 rearward of the pivots 186. Each projection 190 is located slightly forward of a respective forward edge 138 of a respective arm 130 (shown in FIG. 3) to resist twisting of the lever 170 and rearward movement of the lever (thereby resisting removal of the pivots 186 from the recesses 126). The rearward end 106 of the lever 170 forms a generally semicylindrical cam surface 194, the reason for which is explained below.

The switch assembly 86 also includes a retainer clip 198 removably attached to the housing 90. The clip 198 includes a horizontal cross member 200 and a pair of flexible feet 202 extending downward from opposite ends of the cross member 200. Each foot 202 slides downward into a respective vertical recess 132 in a respective arm 130 and has thereon an outwardly-projecting, beveled projection 206 that snaps into the slot 134 in the respective arm 130 to secure the clip 198 to the housing 90. When the clip 198 is secured to the housing in this manner, the feet 202 extend on opposite sides of the lever 170, and the cross member 200 extends above the lever 170 to limit the pivoting motion of the lever 170. The clip 198 also includes a flexible spring tab 214 extending downward from the cross member 210 between the feet 202. The lower end of the spring tab 214 forms a generally semicylindrical cam surface 216 in slidable contact with the cam surface 194 on the end of the lever 170. The spring tab 214 forces the lever 170 to snap into one of the on and off positions.

The housing 90, the lever 170 and the retainer clip 198 are preferably injection-molded out of a suitable plastic. In the preferred embodiment of the invention, the housing 90 and the lever 170 are made of Polycarbonate, KOTEC K-30FR, and the retainer clip 198 is made of POM, DUPONT 500P, both of which are known to those skilled in the art. This enables these parts to be made easily and inexpensively.

The microswitch 146, which is removably mounted in the recess 142 as mentioned above, includes a main body 222 and an operating button 226 projecting from the top of the body 222 such that the lever 170 depresses the button 226 when the lever 170 is in the on position. The microswitch 146 also includes a pair of electrical contacts 230 connected to the motor 46 via wiring. While many suitable microswitches can be used, the microswitch 146 is preferably manufactured by Zippy USA, Inc., Model V3-10L63G1-1.

To assemble the water-level-sensing system 58, the microswitch 146 is snapped into the recess 142 in the switch housing 90 and the lever 170 is mounted on the switch housing 90 as described above. The retainer clip 198 is then snapped into place over the lever 170. The switch assembly 86 is inserted into the motor housing 48 through a window 232 in the housing 48, so that the mounting portion 158 abuts the outside of the housing 48 and the remainder of the switch housing 90 is inside the motor housing 48. The assembly 86 is then secured to the housing 48 with the screw 166. Electrical connections are made between the motor 46 and the switch assembly 86 and then the motor housing 48 is closed. The connecting rod 62 is located in the lever aperture 182 with the limit stops 74, 78 above and below the lever 170. The limit stops 74, 78 can be adjusted for the desired high and low water levels 30 in the sump 14.

When the water level 30 in the sump 14 rises above a predetermined level, the lower limit stop 78 moves the first end 174 of the lever 170 upward, thereby moving the lever 170 from the off position to the on position. The spring tab 214 causes the lever 170 to snap to the on position once the cam surface 194 moves past the center of the cam surface 216. This movement of the lever 170 causes the lever to engage and depress the microswitch button 226, thereby closing the circuit and turning the motor 46 on.

As the water level 30 in the sump 14 falls, the float 82 and thus the connecting rod 62 move downward until the upper limit stop 74 contacts and moves the first end 174 of the lever 170 downward, thereby moving the lever 170 from the on position to the off position. The spring tab 214 causes the lever 170 to snap to the off position once the cam surface 194 moves past the center of the cam surface 216. This movement of the lever 170 causes the lever to disengage the microswitch button 226, thereby opening the circuit and turning the motor 46 off.

Figure 6:
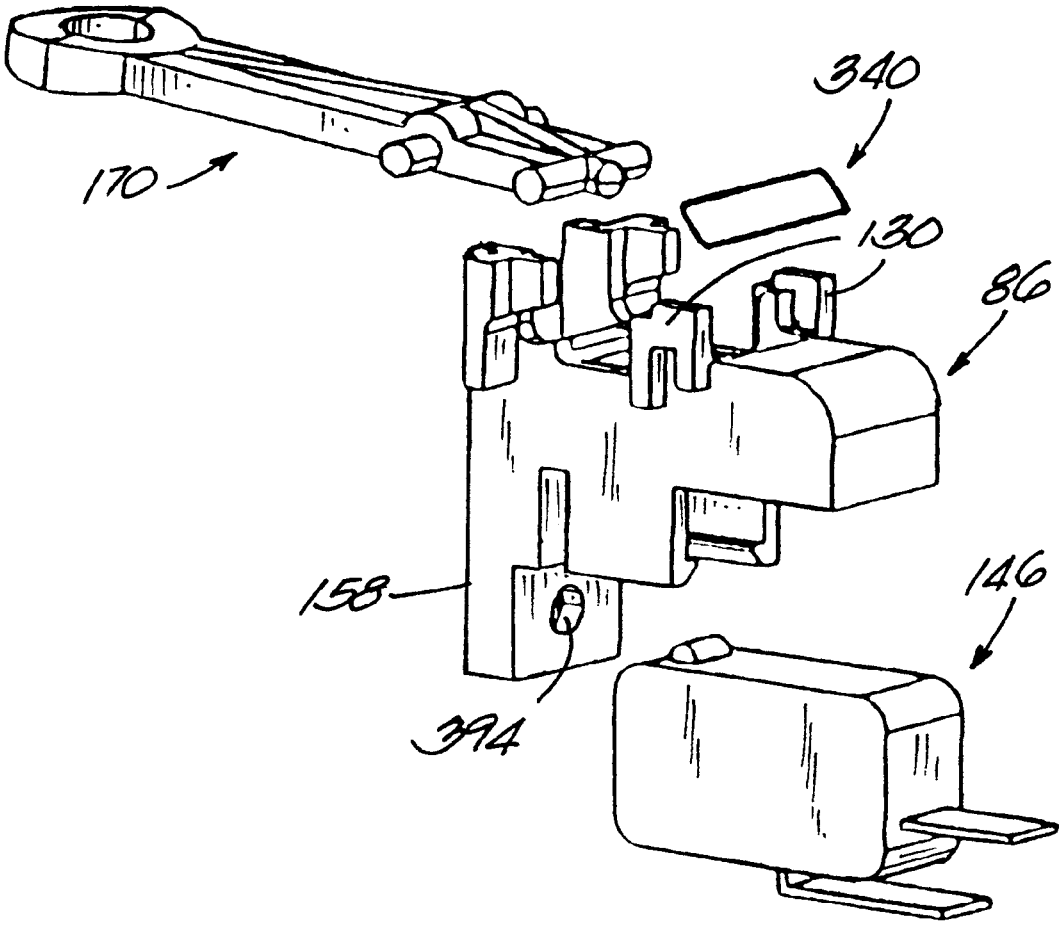
FIG. 6 is an exploded perspective view of an alternative switch assembly.

An alternative switch assembly 386 is illustrated in FIG. 6. Except as explained below, the assembly 386 is substantially identical to the assembly 86, and common elements have been given the same reference numerals. Instead of the retainer clip 198, the assembly 386 includes a spring clip 390 to hold the lever 170 in place. The arms 130 are modified to accept the clip 390. Instead of the recess 162, the spring housing 90 has therein an aperture 394 through which the screw 166 extends.

Various features of the invention are set forth in the following claims.

What is claimed is:

1. A pedestal sump pump comprising:

a base;

a support post extending upward from the base;

a motor mounted on the support post, the motor including a motor housing; and a water-level-response system including a float rod, a switch having a main body and being mounted within the motor housing, and an actuating member operably connected to the switch, the member extending from the motor housing and being operably connected to the float rod, such that a variation in water level moves the float rod and the actuating member and toggles the switch.

2. The pump of claim 1 and further comprising a switch housing removably supporting the main body of the switch.

3. The pump of claim 2, wherein the actuating member is a lever pivotably mounted to the switch housing such that the lever toggles between on and off positions.

4. The pump of claim 3, and further comprising a retaining clip removably mounted on the switch housing for retaining the lever in position.

5. The pump of claim 4, where the retaining clip engages the lever so as to cause the lever to snap into the on and off positions.

6. The pump of claim 4, wherein the switch housing, the lever and the retaining clip are made of injection-molded plastic.

7. The pump of claim 6 wherein the switch housing has therein a recess into which the switch snaps, and wherein the retaining clip snaps onto the switch housing.

8. The pump of claim 1, wherein the switch further includes an operating button, and wherein the actuating member operably connects to the operating button such a variation in water level moves the float rod and the actuating member and toggles the operating button.

9. The pump of claim 2, wherein the switch housing is secured to the motor housing with a single fastener.

10. The pump of claim 9, wherein the switch housing has therein a recess, and wherein the fastener is a screw that extend through the recess and into the motor housing.

11. The pump of claim 10, wherein the motor housing has an outside, and wherein the switch housing includes a mounting portion having therein the recess and abutting the outside of the motor housing.

12. A pedestal sump pump comprising:

a base;

a support post extending upward from the base;

a motor mounted on the support post, the motor including a motor housing; and a water-level-response system including a float rod, a switch mounted within the motor housing, and an actuating member operably connected to the switch, the member extending from the motor housing and being operably connected to the float rod, such that a variation in water level moves the float rod and the actuating member and toggles the switch, wherein the actuating member is a lever pivotably mounted to the switch housing such that the lever toggles between on and off positions; and a retaining clip removably mounted on the switch housing for retaining the lever in position, wherein the retaining clip includes a cross member extending over the lever, and a pair of feet that extend from the cross member and that snap onto the switch housing.

13. A pedestal sump pump comprising:

a base;

a support post extending upward from the base;

a motor mounted on the support post, the motor including a motor housing; and a water-level-response system including a float rod, a switch mounted within the motor housing, and an actuating member operably connected to the switch, the member extending from the motor housing and being operably connected to the float rod, such that a variation in water level moves the float rod and the actuating member and toggles the switch, wherein the actuating member is a lever pivotably mounted to the switch housing such that the lever toggles between on and off positions;

a retaining clip removably mounted on the switch housing for retaining the lever in position, wherein the retaining clip engages the lever so as to cause the lever to snap into the on and off positions; and wherein the lever has thereon a lever cam surface, and wherein the retaining clip has thereon a spring tab with a cam surface engaging the lever cam surface so as to cause the lever to snap into the on and off positions.

14. A switch assembly comprising:

a switch housing having therein a microswitch recess;

a microswitch removably mounted in the microswitch recess;

an actuating lever pivotably mounted on the switch housing such that the lever toggles between on and off positions, the lever being operably connected to the switch;

a retaining clip removably attached to the switch housing to limit movement of the lever, the clip including a flexible portion contacting the lever to snap the lever into the on and off positions; and wherein the lever has thereon a lever cam surface, and wherein the retaining clip has thereon a spring tab with a cam surface engaging the lever cam surface so as to cause the lever to snap into the on and off positions.

15. The assembly of claim 14 the switch housing including a mounting portion including a screw recess receiving a screw for mounting the switch housing on a structure.

16. The assembly of claim 14, the switch housing including flexible tabs adjacent the microswitch recess to retain the microswitch within the microswitch recess.

17. The assembly of claim 14, wherein the retaining clip includes a cross member extending over the lever, and a pair of feet that extend from the cross member and that snap onto the switch housing.

18. The assembly of claim 14, wherein the switch housing, the lever and the retaining clip are made of injection-molded plastic.

19. The assembly of claim 18 wherein the microswitch snaps into the switch recess, and wherein the retaining clip snaps onto the switch housing.

20. A pedestal sump pump comprising:

a base;

a support post extending upward from the base;

a motor mounted on the support post, the motor including a motor housing having an outside and having therein a window; and a water-level-response system attached to the motor and including a connecting rod with upper and lower ends and including upper and lower limit stops in a spaced-apart relation on the rod, a float mounted on the lower end of the rod, and a switch assembly mounted in the window of the motor housing, the assembly including a switch housing including a first pair of recesses, a second pair of recesses, a microswitch recess, flexible tabs adjacent the microswitch recess, and a mounting portion including a recess, the mounting portion abutting the outside of the motor housing such that the remainder of the switch housing is inside the motor housing, a lever with first and second ends, the lever being pivotably mounted to the switch housing such that the lever toggles between on and off positions, the lever including an aperture in the first end of the lever sized to slidably receive the connecting rod, a pair of pivots each pivotably mounted within a respective on of the first pair of recesses of the switch housing, a pair of projections in slidable contact with the housing to retain the pivots in the first pair of recesses, and a cam surface formed on the second end of the lever, a retainer clip removably attached to the housing and retaining the lever in place, the clip including two feet, each having a projection that snaps into a respective one of the second pair of recesses to removably secure the retainer clip in place, a cross member connecting the two feet, and a spring tab connected to the cross member and including a cam surface slidably contacting the cam surface on the lever, the spring tab causing the lever to snap into the on and off positions as the cam surface on the lever moves past the cam surface on the spring tab, a microswitch removably mounted in the microswitch recess and retained by the flexible tabs, the microswitch including a body, a button contacting the lever, and a pair of electrical contacts connecting the microswitch with the motor, and a single mounting screw extending through the mounting portion recess and into the motor housing for connecting the switch housing to the motor housing.

* * * * *